US005575411A

United States Patent [19]

Hightower

[11] Patent Number: 5,575,411

[45] Date of Patent: Nov. 19, 1996

[54] BUTT STOCK SLING ATTACHING DEVICE FOR A SHOTGUN

[76] Inventor: Floyd L. Hightower, 5617 Lake Highlands Dr., Waco, Tex. 76710

[21] Appl. No.: 387,401

[22] Filed: Mar. 6, 1995

[51] Int. Cl.[6] ..... F41C 33/00

[52] U.S. Cl. ..... 224/149; 224/150; 224/257; 224/913

[58] Field of Search ..... 224/149, 150, 224/257, 258, 917, 913; 24/2.5; 42/85

[56] References Cited

U.S. PATENT DOCUMENTS

| | | | |
|---|---|---|---|
| D. 304,977 | 12/1989 | Pappas . | |
| 2,830,747 | 4/1958 | Creste | 224/913 |
| 2,884,172 | 4/1959 | Kubo . | |
| 2,915,233 | 12/1959 | Moomaw . | |
| 3,182,871 | 8/1963 | Gossler . | |
| 4,098,441 | 7/1978 | Campbell . | |
| 4,760,944 | 8/1988 | Hughes . | |
| 5,092,505 | 3/1992 | Olschlager . | |

*Primary Examiner*—Linda J. Sholl
*Attorney, Agent, or Firm*—Diller, Ramik & Wight, PC

[57] ABSTRACT

A butt stock sling attaching device is disclosed for securing a sling to a shotgun, rifle or the like. The attaching device includes a primary loop having a stock toe engaging bight and opposite thereto carrying a "D"-shaped ring to which a sling is attached. A pair of secondary loop portions are attached at one end to side portions of the primary loop and are brought into overlying relationship to a stock comb with hook and loop fastenings maintaining the secondary loop in secure, though removable, fastening relationship to each other. Preferably, the primary loop includes a half-twist for achieving proper orientation of the "D"-shaped ring relative to an associated sling.

11 Claims, 1 Drawing Sheet

BUTT STOCK SLING ATTACHING DEVICE FOR A SHOTGUN

BACKGROUND OF THE INVENTION

This invention is directed to an attaching device for attachment to the butt stock of a shotgun, rifle or the like and to which is in turn attached a shotgun or rifle sling. Typical of sling attaching devices of the type to which the present invention is directed can be found in U.S. Pat. No. 2,884,172 issued to Kubo which is considered to be the most pertinent of several patents selected during a search of the instant subject matter. Other patents uncovered during the latter search include U.S. Pat. Nos. 2,915,233; 3,182,871; 4,098,441; 4,760,944 and 5,092,505 issued respectively to Moomaw, Gossler, Campbell, Hughes and Olschleger. U.S. Des. Pat. No. 304,977 in the name of Pappas completes the totality of patents uncovered during the latter-noted search.

SUMMARY OF THE INVENTION

In keeping with the foregoing, a primary object of the present invention is to provide a novel butt stock sling attaching device for securing a sling to a shotgun, rifle or the like which is relatively inexpensive to manufacture, can be easily secured to an associated butt stock, when so secured securement is reliable, and can be readily and quickly removed from the butt stock. The butt stock sling attaching device of the present invention provides the foregoing advantages through a unique construction in which a primary loop is formed from a strap having opposite ends sewn together and retaining thereby a "D"-ring for an associated sling. A secondary loop is formed of two separate straps each having an end sewn at diametrically opposite portions to the primary loop and carrying conventional loop and hook fastening means typically known as Velcro®. A portion of the primary loop remote from the "D"-ring embraces a stock toe of the butt stock and the two loop portions of the secondary loop are brought into intimate engagement with the stock comb and secured to each other through the hook and loop fastenings. Once thus attached to the butt stock, the associated shotgun or rifle can be carried or utilized in a conventional manner when the weapon is being aimed with total assurance that the sling and weapon are supported firmly, effectively and efficiently. By the same token, the butt stock sling attaching device can be just as quickly and efficiently removed from the stock butt by simply disengaging the hook and loop fastenings, opening the secondary loop portions and slipping the primary loop from the stock toe.

The butt stock sling attaching device preferably includes as part of the primary loop a half-twist therein which achieves proper orientation of the "D"-ring relative to the sling when the latter is associated with a shotgun, rifle or the like.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
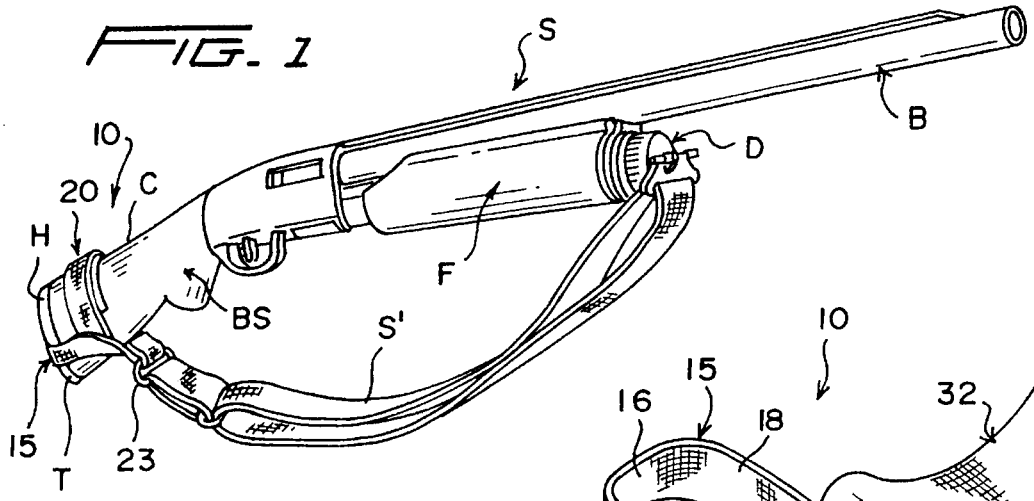
FIG. 1 is a perspective view, and illustrates a shotgun to which a sling is attached at one end by a sling swivel stud and an associated fastening cap and at an opposite end by the butt stock sling attaching device of the invention.

A shotgun S is illustrated in FIG. 1 of the drawings, and includes a barrel B, a fore stock F and a butt stock BS. The butt stock BS includes a stock heel H, a stock toe T and a stock comb C. A conventional sling S' is secured at one end to a threaded end (not shown) of a magazine (also not shown) projecting slightly beyond the fore stock F by a cap-like sling attaching device D which is disclosed in Ser. No. 08/399,936, pending in the name of Floyd filed Mar. 6, 1995 Hightower. An opposite end of the sling S' is secured to the butt stock BS by a novel butt stock sling attaching device of the present invention which is generally designated by the reference numeral 10 (FIGS. 1 through 4).

The butt stock sling attaching device 10 includes a primary loop 15 (FIGS. 2 through 4) and a secondary loop 20, each of which is preferably constructed from 1" and 2" wide nylon webbing.

Figure 2:
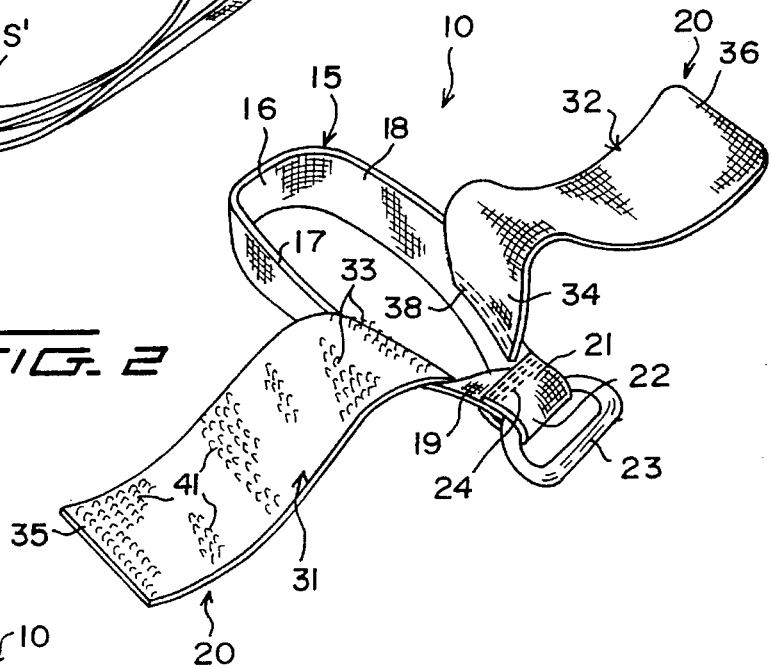
FIG. 2 is a perspective view of the butt stock sling attaching device of the present invention, and illustrates a primary loop, a secondary loop formed of two looped portions having respective loop and hook fastenings, and a "D"-ring carried by the primary loop.

The primary loop 15 is a single piece of nylon webbing or web which includes a half-twist and is of a generally elongated oval-shaped configuration, as is best illustrated in FIG. 2. A first end or end portion 16 of the primary loop is a generally bight portion and is united to opposite side portions 17, 18 which have respective opposite ends 19, 21 with the end 19 being received within an overfolded portion or loop portion 22 forming a channel (unnumbered) encircling a "D"-ring 23. Stitching 24 passes through opposite sides of the looped portion 22 and the end 19 to fasten the latter securely to each other.

The secondary loop 20 includes a first secondary loop portion 31 and a secondary loop portion 32 having respective first ends 33, 34 and respective opposite second ends 35, 36. The ends 33, 34 are also sewn by stitching 38 to inside surfaces (unnumbered) of the respective side portions 17, 18. Fastening means in the form of loop fastenings 42 and hook fastenings 41, such as conventional Velcro® fastenings, are carrying by opposite sides or surfaces (unnumbered) of the respective loop portion 32 and hook portion 31 of the secondary loop 20.

Figure 3:
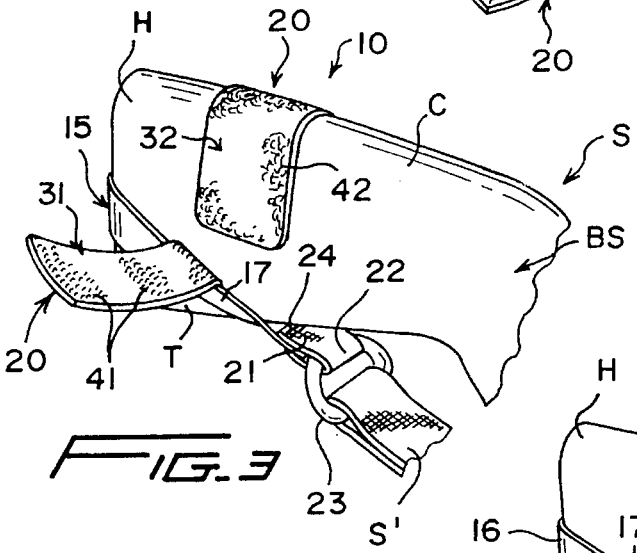
FIG. 3 is a fragmentary perspective view of the butt stock sling attaching device, and illustrates the primary loop engaging the stock toe of the butt stock and one of the secondary looped portions intimately folded about the stock comb incident to the opposite secondary loop portion being secured thereto.

In order to assembly or secure the butt stock sling attaching device 10 to the butt stock BS of the shotgun S, the stock toe T is slipped between the side portion 17, 18 and into engagement with the bight portion 16, as is most readily apparent in FIG. 3. The second secondary loop portion 32 is then folded over the comb stock C to the position shown in FIG. 3 after which the first secondary loop portion 31 is overfolded upon the second secondary loop portion, as shown in FIG. 4, bringing the fastenings 41, 42 into firm, though releasable, securing engagement with each other.

Figure 4:
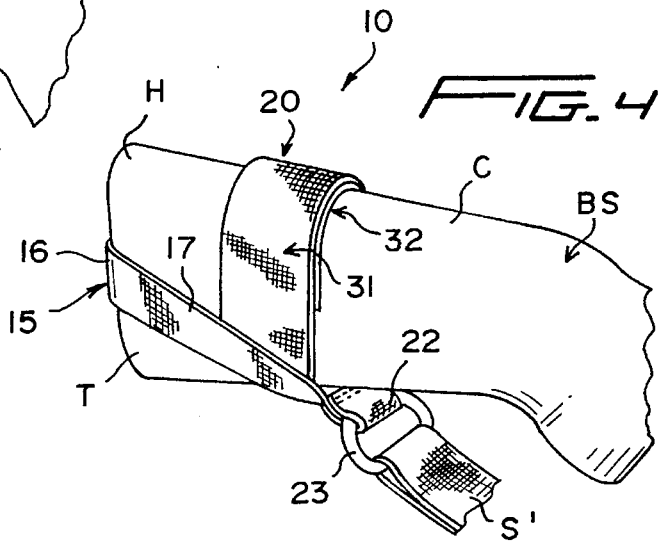
FIG. 4 is a fragmentary perspective view of the butt stock sling attaching device and butt sock, and illustrates the secondary loop secured upon itself and retaining the butt stock sling attaching device secured to the butt stock.

When thus assembled in the manner shown in FIGS. 1 and 4, the butt stock sling attaching device 10 is securely held to and upon the butt stock BS, yet can be readily removed therefrom.

Although a preferred embodiment of the invention has been specifically illustrated and described herein, it is to be understood that minor variations may be made in the apparatus without departing from the spirit and scope of the invention, as defined the appended claims.

I claim:

1. A butt stock sling attaching device comprising a primary loop and a secondary loop; said primary loop being defined by a single one-piece web of material folded upon itself and at least half-twisted upon itself to form at least a half-twist therein to define opposite side portions integrally joined to each other at one end by an integral folded stock toe engaging portion and a second opposite end defined by terminal ends of said primary loop, means for attachment to a sling carried by said primary loop terminal ends; means for fastening said primary loop terminal ends to each other to maintain said at least half-twist, said secondary loop being defined by first and second secondary loop portions, a first end of said first secondary loop portion being connected to one of said primary loop side portions and a first end of said second secondary loop portion being connected to another of said primary loop side portions, and means for removably securing together second ends of said first and second secondary loop portions.

2. The butt stock sling attaching device as defined in claim 1 wherein said sling attachment means is a "D"-shaped ring.

3. The butt stock sling attaching device as defined in claim 2 wherein one of said terminal ends is folded into a folded portion encircling a portion of said "D"-shaped ring, and means for stitching said folded portion and the other of said terminal ends to each other to confine said "D"-shaped ring within said folded portion.

4. The butt stock sling attaching device as defined in claim 2 wherein said means for fastening said terminal ends to each other is stitching.

5. The butt stock sling attaching device as defined in claim 1 wherein said removably securing means includes hook and loop means carried by said first and second secondary loop portion second ends for releasably securing said first and second secondary loop portion second ends together.

6. The butt stock sling attaching device as defined in claim 1 wherein said means for fastening said primary loop terminal ends to each other is stitching.

7. The butt stock sling attaching device as defined in claim 1 wherein said sling attachment means includes a ring, one of said terminal ends is folded into a folded portion encircling a portion of said ring, and means for stitching said folded portion and the other of said terminal ends to each other to confine said ring within said folded portion.

8. A butt stock sling attaching device comprising a primary loop and a secondary loop; said primary loop being defined by opposite side portions joined at one end by a stock toe engaging portion and a second opposite end carrying means for attachment to a sling; said secondary loop being defined by first and second secondary loop portions, a first end of said first secondary loop portion being connected to one of said primary loop side portions and a first end of said second secondary loop portion being connected to another of said primary loop side portions, means for removably securing together second ends of said first and second secondary loop portions, said primary loop second opposite end is defined by terminal ends of said primary loop opposite side portions, said sling attachment means includes a ring, one of said terminal ends is folded into a folded portion encircling a portion of said ring, and means for securing said folded portion and the other of said terminal end to each other to confine said ring within said folded portion.

9. A butt stock sling attaching device comprising a primary loop and a secondary loop; said primary loop being defined by opposite side portions joined at one end by a stock toe engaging portion and a second opposite end carrying means for attachment to a sling; said secondary loop being defined by first and second secondary loop portions, a first end of said first secondary loop portion being connected to one of said primary loop side portions and a first end of said second secondary loop portion being connected to another of said primary loop side portions, means for removably securing together second ends of said first and second secondary loop portions, said primary loop second opposite end is defined by terminal ends of said primary loop opposite side portions, said sling attachment means includes a ring, one of said terminal ends is folded into a folded portion encircling a portion of said ring, and means for stitching said folded portion and the other of said terminal end to each other to confine said ring within said folded portion.

10. A butt stock sling attaching device for a shotgun or a rifle comprising a primary loop and a secondary loop; said primary loop being defined by opposite side portions joined at one end by a stock toe engaging portion and a second opposite end carrying means for attachment to a sling; said secondary loop being defined by first and second secondary loop portions, a first end of said first secondary loop portion being connected to one of said primary loop side portions and a first end of said second secondary loop portion being connected to another of said primary loop side portions, means for removably securing together second ends of said first and second secondary loop portions, said primary loop is at least half-twisted upon itself to form at least a half-twist therein, and means for maintaining said at least half-twist in said primary loop.

11. A butt stock sling attaching device for a shotgun or a rifle comprising a primary loop and a secondary loop; said primary loop being defined by opposite side portions joined at one end by a stock toe engaging portion and a second opposite end carrying means for attachment to a sling; said secondary loop being defined by first and second secondary loop portions, a first end of said first secondary loop portion being connected to one of said primary loop side portions and a first end of said second secondary loop portion being connected to another of said primary loop side portions, means for removably securing together second ends of said first and second secondary loop portions, said primary loop is half-twisted upon itself, to form a half-twist therein and means for maintaining said half-twist in said primary loop.

* * * * *